United States Patent [19]

Nordquist et al.

[11] Patent Number: 4,503,755

[45] Date of Patent: Mar. 12, 1985

[54] LOUVER SYSTEM

[75] Inventors: Dennis D. Nordquist, Phoenix; Derron G. Vandewege, Mesa, both of Ariz.

[73] Assignee: Idea Development Engineers of Arizona, Inc., Tempe, Ariz.

[21] Appl. No.: 418,310

[22] Filed: Sep. 15, 1982

[51] Int. Cl.[3] ..... F24F 13/10; F16K 1/20

[52] U.S. Cl. ..... 98/110; 16/380; 251/308

[58] Field of Search ..... 16/382, 386, 380; 98/40 V, 40 VM, 110, 121 R; 251/298, 305, 308; 126/285 R, 288, 289, 291

[56] References Cited

U.S. PATENT DOCUMENTS

| | | | |
|---|---|---|---|
| 2,106,093 | 1/1938 | Goese | 251/308 X |
| 2,285,829 | 6/1942 | Maage, Jr. | 251/305 X |
| 3,191,241 | 6/1965 | Johnson | 98/110 X |
| 3,304,118 | 2/1967 | Jonas | 16/382 X |
| 3,800,688 | 4/1974 | Parrish | 98/110 X |

FOREIGN PATENT DOCUMENTS

| | | | |
|---|---|---|---|
| 1050428 | 12/1966 | United Kingdom | 251/308 |

*Primary Examiner*—Harold Joyce

*Attorney, Agent, or Firm*—Cahill, Sutton & Thomas

[57] ABSTRACT

A louver system is described incorporating louvers having a rectangular outline and incorporating notches on each of the shorter sides of the louver. A one-piece molded hinge pin assembly is provided with a cylindrical extension to act as a hinge pin when the assembly is mounted on the louver. A pair of assemblies are secured to opposite sides of the louver by inserting the bodies of the assemblies into the notches provided therefor in the louver. Each assembly includes a slot into which the sheet metal, of which the louver is formed, is inserted while the cylindrical extension of each of the assemblies extends outwardly from the sides of the louver to provide a hinging axis upon which the louver may be supported and rotated. A detent or hole is provided adjacent each of the notches to accomodate a locking pin molded as part of the assemblies. When the assemblies are inserted into the notches, the locking pins engage the detent or hole to thus secure the hinge pin assembly to the louver.

4 Claims, 6 Drawing Figures

LOUVER SYSTEM

FIELD OF THE INVENTION

The present invention related to louvered systems, and more particularly, to louvers requiring a pivoting or turning axis. Specifically, the present invention pertains to louvers incorporating hinge pins for pivotally or rotationally mounting the louver within a duct or conduit.

BACKGROUND OF THE INVENTION

The utilization of sheet metal louvers in ducts or conduits, such as air-conditioning or other fluid ducts, usually requires that the louvers be pivoted or turned about an axis perpendicular to the axis of the duct. The pivoting of each of the louvers results in an adjustment of the air flow or fluid flow through the duct. Typically, louvers of the prior art have incorporated piano wire hinges or various equivalents thereto as the mechanical means permitting the pivoting of the individual louvers. The prior art has also included the utilization of hinge pins in the form of short metal cylindrical dowels that are secured to the edge of a louver in a variety of ways such as by mechanically clamping, rivoting or staking.

In many ventilation applications, such as evaporative cooling, it is frequently desirable to provide a duct having automatic louvers positioned therein. In the latter circumstances, the louvers will normally be maintained in a closed position simply through the force of gravity on each of the louvers. When cooled air is to enter a room or exhaust air is to be permitted to escape from the room, the air pressure within the duct is sufficient to cause the louvers to open and permit the passage of air into the dwelling or exhaust air to the atmosphere. When the system has been turned off, and the transmission of air through the duct is no longer desired, it is important that the louvers shut and effectively seal the duct. This sealing of the duct against reverse flow is effected by the tolerances permitted between the edges of the pivoting louver and the side wall of the duct or conduit as well as the contacting surfaces of adjacent louvers. The hinge pin utilized with the louver thus becomes an important element in the proper operation of each of the louvers. The louver must obviously be permitted to rotate or pivot without excessive force while nevertheless appropriately assuming its closed position when the force of escaping air is removed from the surface of the louver.

OBJECTS OF THE INVENTION

It is therefore an object of the present invention to provide a louver system incorporating louvers that can be inexpensively manufactured while maintaining precise operation for use in self-closing applications such as cool air ducts.

It is another object of the present invention to provide a louver system having louvers incorporating hinge pin assemblies that can accurately and easily be secured to the opposite edges of each louver to permit the louvers to be mounted closely adjacent the walls of the duct.

It is still another object of the present invention to provide a hinge pin assembly for use on a sheet metal louver wherein the assembly may be formed from a single one-piece molded plastic that is attached to a louver to provide a pin about which the louver may rotate and which is assembly may be attached to the louver without rivots, welding, clamps, or stakes.

These and other advantages will become apparent to those the art as the description thereof proceeds. skilled in the art as the description thereof proceeds.

SUMMARY OF THE INVENTION

The present invention incorporates a plurality of louvers each having a rectangular plane form for mounting in a conventional rectangular duct. Each of the louvers is positioned so that its shorter sides are as close to the sides of the duct as possible whithout permitting the louver to touch the duct. Each louver is provided with a notch in each of its shorter sides and a detent or hole positioned proximate the notch. A one-piece molded plastic hinge pin assembly is formed having an outside shape corresponding to the shape of the notch; the assemblies include a slot to accomodate the thickness of the louver. The assemblies are mounted on the louvers by positioning the assemblies in a corresponding slot and forcing the assembly onto the louver edge to cause the edge to be inserted in the slot provided therefor in the assembly. A locking pin projects into the hole or detent provided in the louver to thereby lock the assembly to the louver.

Each hinge pin assembly includes a hinge pin, molded integrally therewith, which extends outwardly from the assembly and beyond the side edge of the louver. A corresponding opening is provided in the side wall of the duct to admit the respective hinge pins; the openings are provide with a plastic bearing insert for contacting the hinge pins to permit the latter to freely rotate and permit the louver to rotate about the axis of the pin.

BRIEF DESCRIPTION OF THE DRAWINGS

The present invention may more readily be described by reference to the accompanying drawings in which.

DETAILED DESCRIPTION OF A PREFERRED EMBODIMENT

Figure 1:
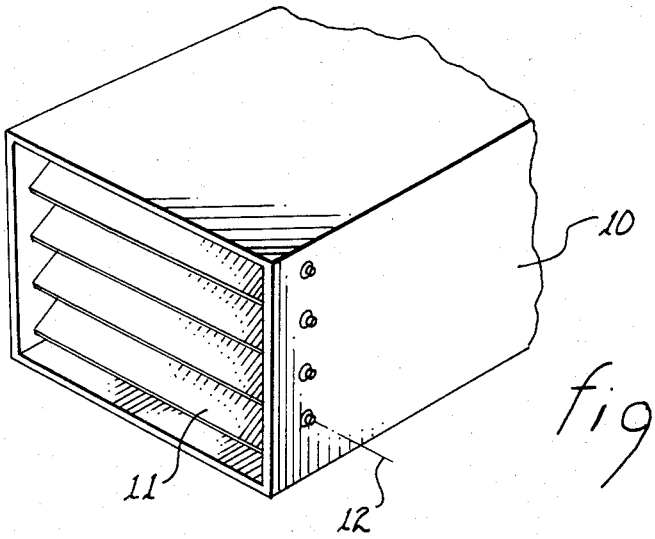
FIG. 1 is an isometric view of a duct having a plurality of louvers mounted therein in accordance with the teachings of the present invention.

Referring to FIG. 1, a duct 10 is shown that may for example be used to conduct air from the interior of a dwelling to the atmosphere. A typical utilization of the system of the present invention would be a duct such as that shown at 10 for conducting spent evaporatively cooled air from the interior of a dwelling to permit fresh air to be drawn into the evaporative cooling system for admission to the dwelling interior. The duct 10 is provided with a plurality of louvers such as that shown at 11 which automatically open as a result of the increased air pressure within the duct when exhaust air is being forced outwardly to the atmosphere. The louver 11 is rotatable about an axis 12 and is balanced in such a way that when the increased air pressure within the duct 10 is removed, the louver pivots or rotates to a closed position in combination with the remaining louvers mounted at the end of the duct.

Figure 2:
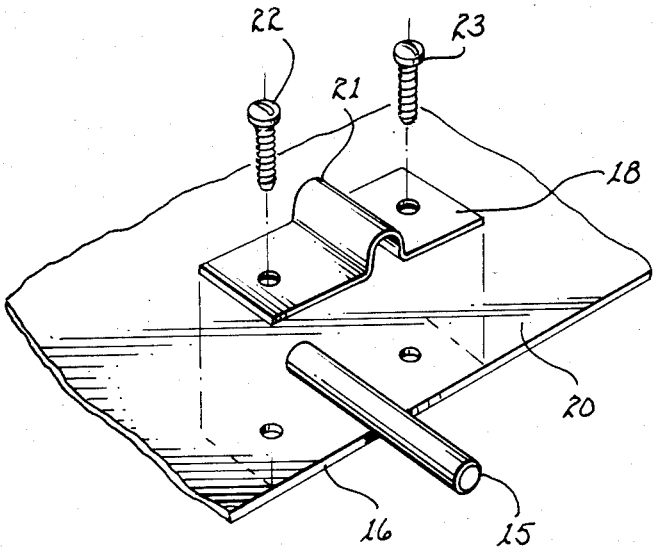
fig. 2 PRIOR ART
FIG. 2 is an exploded view of a prior art hinge pin assembly.

Louvers are mounted for rotation through the utilization of a hinge pin that is secured to each of the shorter sides of the rectangular louver. Hinge pins have been secured to the louvers using a variety of techniques. Referring to FIG. 2, a prior art technique for attaching a hinge pin 15 to a louver 20 is shown. The pin 15 is positioned to permit the pin to extend outwardly from the end edge 16 of the louver and the pin is fixed in position through the use of a clamp 18. The clamp includes a pin-contacting arch 21 that contacts and holds the pin 15 in position; the clamp 18 is secured to the louver 20 by screws 22 and 23. Some prior art clamps incorporate rivots or even welding as a means for securing the clamp in place. When the pin has been secured in accordance with the prior art as shown in FIG. 2, it may be mounted in a duct in a manner shown in FIG. 3.

Figure 3:
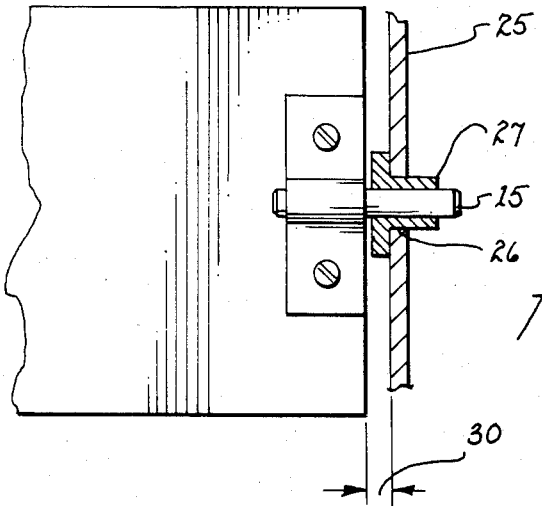
fig. 3 PRIOR ART
FIG. 3 is a plan view of the prior art hinge pin assembly of FIG. 2.

Referring to FIG. 3, it may be seen that a duct side wall 25 is provided with an opening 26 into which a bearing insert 27 is mounted. The insert will normally be a plastic material that will accomodate the insertion of the hinge pin 15. The mounting of the louver in this prior art manner results in a louver-to-side wall gap, such as shown at 30 in FIG. 3 that permits air to pass around the side of the louvers through the duct. This louver end leakage is undesirable in most applications requiring closing louvers. In the application described above wherein the louvers are positioned in an exhaust duct for use in an evaporative cooling system, it is important that the duct and louvers not permit reverse air flow. That is, when the system is turned off such that air pressure within the duct no longer supports the louvers in an open position, the louvers must be able to rotate or pivot to their closed position. When in the closed position, outside air is prevented from entering the dwelling through backward flow into the duct. If the louvers do not properly seal the duct, such as by enabling reverse flow leakage around the sides of the louvers as in FIG. 3, improper ventilation control within the dwelling results.

Figure 4:
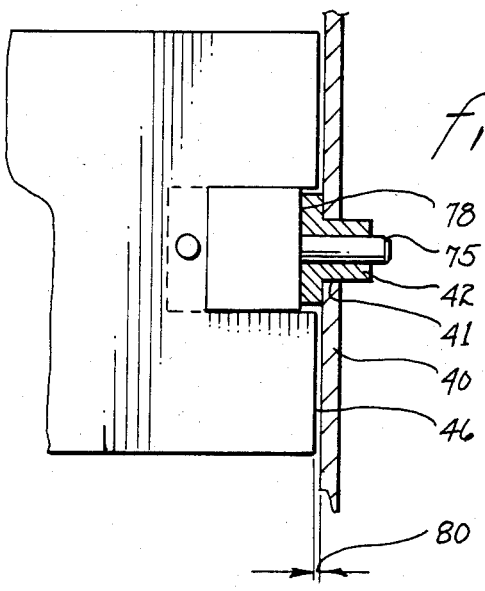
FIG. 4 is a plan view of a louver and hinge pin assembly constructed in accordance with the teachings of the present invention.
Figure 5:
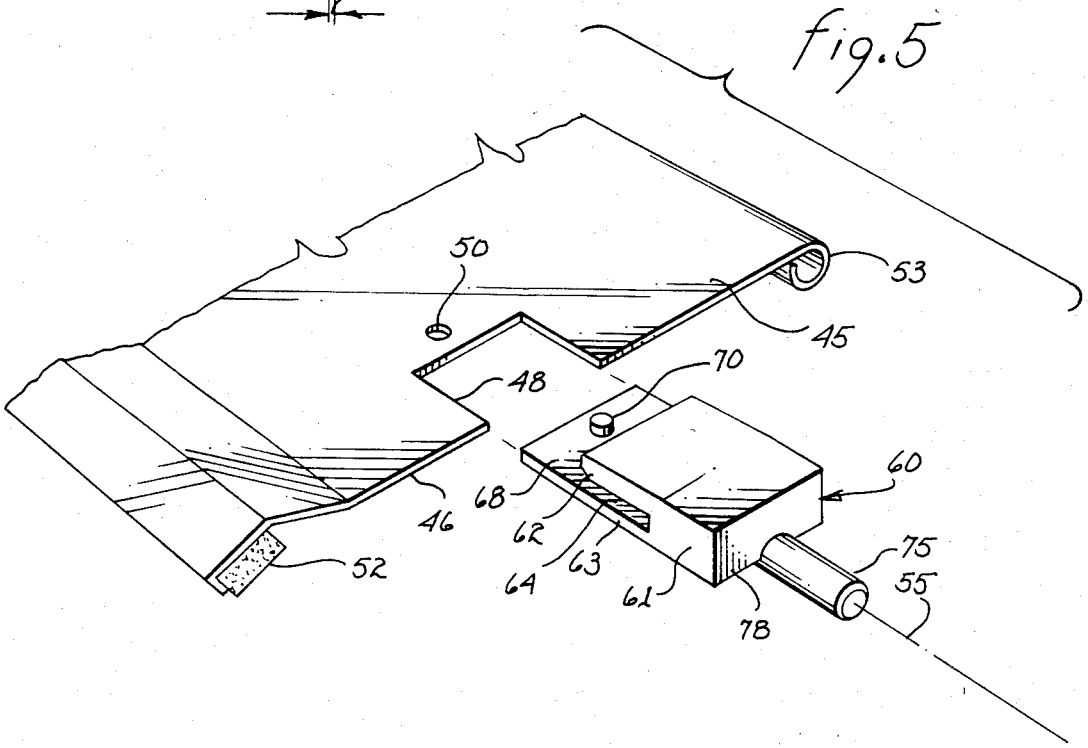
FIG. 5 is an isometric view of an end of a louver having a hinge pin assembly positioned adjacent thereto formed in accordance with the teachings of the present invention.
Figure 6:
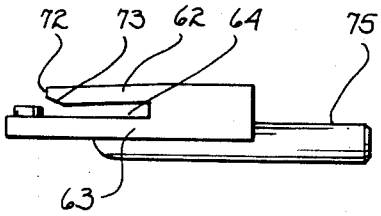
FIG. 6 is a side elevational view of a hinge pin assembly constructed in accordance with the teachings of the present invention.

Referring now to FIGS. 4, 5 and 6, the system of the present invention may be described. A duct side wall 40 is provided with an opening 41 as described previously in connection with the prior art. Similarly, a plastic bearing insert 42 is provided to accomodate a hinge pin. The louver 45 is provided with an end edge 46 having a notch 48 therein. A locking hole 50 may be formed in the louver at the same time that the notch 48 is formed.

A resilient seal 52 is cemented to one of the longer edges of the louver to provide a sealing surface to contact and appropriately seal against an adjacent louver when the louvers are in their closed position. The opposite longer edge 53 of the louver may be rolled to provide an appropriate mass for properly balancing the louver. The louver, with the rolled edge 53, and resilient seal 52, can be balanced so that the force of air pressure within the duct during exhausting of spent air results in the rotation of the louver about an axis 55. The opening of the louvers is maintained by the air pressure within the duct; when the air pressure is removed, each of the louvers such as that shown in 45 rotates about its axis 55 to a closed position wherein the seal 52 contacts the next adjacent louver and forms a seal to prevent backflow of air into the duct. The rotational or pivotal axis of the louver 45 is provided through the use of a hinge pin assembly 60. The hinge pin assembly is formed from a single one-piece molded plastic body that may be formed from conventional commercially available plastics such as the material known commercially by the trademark Delrin. The hinge pin assembly 60 is formed having a body 61 with an outer shape conforming to the notch 48 in the louver 45. In the embodiment chosen for illustration, the body 61 is basically a rectangular parallelepiped that corresponds in its width to the width of the notch 48. The body 61 includes a pair of ledges 62 and 63 forming a slot 64 therebetween. It may be noted that the ledge 63 extends further from the body 61 than the ledge 64. The extension of the ledge 63 provides a platform 68 that supports a locking pin 70 molded integrally therewith.

The ledge 62 includes one edge 72 that is chamfered at 73 for reasons to become apparent as the description proceeds. The hinge pin 75 extends along the axis 55 that is parallel to but offset from the plane of the slot 64. It may be noted that the ledge 62 is molded in such a manner that it bends downwardly (as viewed in FIG. 6) slightly with respect to the ledge 63 to thereby result in the slot 64 having a slight closing taper as the slot approaches the chamfered edge 73 of the ledge 62. It may be noted, that when the hinge pin assembly 60 is positioned in the notch 48, and the louver 45 is inserted into the slot 64, the locking pin 70 will extend into and "snap" into the hole 50. It will be apparent that the hole 50 may be replaced by a detent or similar structure to accomodate the locking pin 70 such that when the pin is positioned in the hole 50 or equivalent detent, the hinge pin assembly 60 is locked onto the louver 45. When the hinge pin assembly 60 is thus secured to the louver 45, and the locking pin intercedes into the plane of the slot 64 to engage the hole 50 or equivalent detent, it may be noted that the hinge pin assembly is positioned inwardly of the louver 45 away from the end edge 46. That is, the outer surface 78 of the hinge pin assembly is positioned away from the wall 40 of the duct and is further from the wall 40 than the end edge 46 of the louver. This relationship of the hinge pin assembly, wall 40, and end edge 46 may most be readily be seen by reference to FIG. 4. Thus, the hinge pin assembly 60 is mounted and secured to the louver in a position out of the way of the bearing insert 79 to thereby permit the end edge 46 to closely approach the wall 40 and minimize the end gap 80 to permit more effective sealing of the duct by the louver when the louver is in its closed position.

It may be seen that the louver system of the present invention incorporates notched louvers and hinge pin assemblies that can be easily attached to the louver without the use of prior art techniques. In fact, the hinge pin assemblies can be mounted by #hand without the aid of tools. When the hinge pin assemblies are thus mounted on the louvers, the hinge pins extend outwardly beyond the end edges of the louvers while the hinge pin assemblies are in a recessed position away from the end edge to permit the end edge to be positioned very closely to the duct wall and thus minimize leakage around the edges of the louvers. It will be apparent to those skilled in the art that many modifications in the embodiment chosen for illustration may be made without departing from the spirit and scope of the invention.

I claim:

1. In a louver system having an air conduit the flow through which is to be regulated by the positioning of a movable louver, the improvement comprising:

a. a louver extending across said conduit;

b. means defining a notch in an edge of said louver, said edge and notch positioned adjacent to a wall of said conduit;

c. means defining a locking hole in said louver proximate said notch;

d. a one piece molded plastic hinge pin assembly having a cylindrical pin extending therefrom for insertion into an opening provided therefor in said wall;

e. said hinge pin assembly having a slot therein to accommodate the insertion of an edge of said louver and having an outer form conforming to said notch to permit said assembly to be inserted in said notch, said assembly when positioned in said notch having only said cylindrical pin extending away from said louver beyond said edge; and f. said one piece assembly also including a locking pin formed integrally therewith extending perpendicular to the plane of said slot and positioned to intrude into the plane of said slot to permit said pin to extend into said locking hole when said louver is inserted in said slot.

2. The combination set forth in claim 1 wherein said one piece assembly comprises a molded plastic parallelepiped having a pair of ledges extending therefrom forming a slot therebetween to accommodate the insertion of an edge of said louver, one of said ledges extending further and being longer than the other, said locking pin extending from the longer of said ledges perpendicular to the plane of said slot and positioned to intrude into the plane of said slot to permit said pin to extend into said locking hole provided therefor in said louver when said assembly is inserted in said slot, the shorter of said ledges including a chamfered edge facing said locking pin and opposing the longer of said ledges.

3. The combination set forth in claim 2 wherein said slot is formed having a closing taper as it approaches said chamfered edge.

4. The combination set forth in claim 1 wherein said cylindrical pin extends along an axis parallel to but offset from the plane of the slot.

* * * * *